United States Patent [19]

Connaught et al.

[11] 4,417,986

[45] Nov. 29, 1983

[54] PROCESS FOR REDUCING THE CHEMICAL OXYGEN DEMAND OF SPENT ALKALINE REAGENTS

[75] Inventors: Ruth M. Connaught, Turnersville, N.J.; Vernon F. Coty, West Chester, Pa.; Michael Sedlak, West Deptford, N.J.

[73] Assignee: Mobil Oil Corporation, New York, N.Y.

[21] Appl. No.: 243,310

[22] Filed: Mar. 13, 1981

[51] Int. Cl.[3] ..... C10G 19/00; C10G 19/08; C10G 27/12

[52] U.S. Cl. ..... 210/759; 208/226; 208/235; 210/916; 423/551; 423/555

[58] Field of Search ..... 208/226, 235; 210/721, 210/759, 908, 916; 423/551, 555

[56] References Cited

U.S. PATENT DOCUMENTS

| | | | |
|---|---|---|---|
| 2,001,715 | 5/1935 | Fischer | 423/642 X |
| 2,369,771 | 2/1945 | Bond | 423/183 |
| 2,425,414 | 8/1947 | Bond | 423/183 |
| 2,432,301 | 12/1947 | Fetterly | 208/235 |
| 2,472,473 | 6/1949 | Fetterly | 208/235 |
| 2,516,837 | 8/1950 | Happel et al. | 423/181 |
| 2,525,583 | 10/1950 | Bond et al. | 423/183 |
| 2,583,136 | 1/1952 | Bond | 423/183 |
| 2,599,449 | 6/1952 | Happel et al. | 423/183 |
| 2,651,595 | 9/1953 | Moulthrop | 208/204 |
| 2,679,537 | 5/1954 | Knowlton | 208/235 |
| 2,719,109 | 9/1955 | Harper et al. | 208/235 |
| 2,740,748 | 4/1956 | Meguerian | 208/205 |
| 2,747,969 | 5/1956 | Backensto et al. | 423/183 |
| 2,757,074 | 7/1956 | Grayson et al. | 423/183 |
| 2,760,909 | 8/1956 | Zublin | 208/227 |
| 2,794,767 | 6/1957 | Gleim et al. | 208/235 |
| 2,845,382 | 7/1958 | Leum et al. | 208/226 |
| 2,853,432 | 9/1958 | Gleim et al. | 208/284 |
| 2,882,132 | 4/1959 | Nieuwenhuis et al. | 423/183 |
| 3,023,084 | 2/1962 | Thomas, Jr. | 423/183 |
| 3,262,753 | 7/1966 | Urano et al. | 208/235 |
| 4,090,954 | 5/1978 | Ward | 208/206 |
| 4,163,044 | 7/1979 | Woertz | 423/551 |

FOREIGN PATENT DOCUMENTS

| | | | |
|---|---|---|---|
| 505300 | 8/1954 | Canada | 208/235 |

OTHER PUBLICATIONS

"Hydrogen Peroxide Waste Treatment by Industry", FMC.

"Manual on Disposal of Refinery Wastes—Volume on Liquid Wastes", Chapter 15—Common Refinery Wastes and Process Summaries, 1969, American Petroleum Institute.

*Primary Examiner*—Delbert E. Gantz
*Assistant Examiner*—O. Chaudhuri
*Attorney, Agent, or Firm*—Alexander J. McKillop; Michael G. Gilman; Charles J. Speciale

[57] ABSTRACT

An aqueous solution of spent alkaline reagent containing alkali metal mercaptides obtained from the treatment of a mercaptan-containing (i.e., sour) hydrocarbon fluid with an alkali metal hydroxide, e.g., sodium hydroxide (caustic) or potassium hydroxide, is contacted with hydrogen peroxide to convert at least a substantial amount of the alkali metal mercaptides to alkali metal sulfates and carbonates thereby substantially reducing the chemical oxygen demand (COD) of the aqueous spent alkaline reagent solution.

11 Claims, No Drawings

PROCESS FOR REDUCING THE CHEMICAL OXYGEN DEMAND OF SPENT ALKALINE REAGENTS

BACKGROUND OF THE INVENTION

1. Field of the Invention

This invention relates to the field of processes for treating spent alkaline reagents and, more particularly, to such processes in which the spent alkaline reagents are obtained from the treatment of hydrocarbon fluids such as are encountered in petroleum refining operations.

2. Description of the Prior Art

Hydrocarbon distillates such as gasoline, naphtha, jet fuel, kerosene, diesel fuel, or fuel oil containing mercaptans and hydrogen sulfide are commonly referred to as "sour" and are usually unsatisfactory for their intended uses. Mercaptans have a highly offensive odor even in minor concentrations. Their presence in gasoline impairs its susceptibility to octane-improvement through the addition of compounds such as tetraethyl lead. When mercaptans are pyrolyzed they yield undesirable atmospheric contaminants in the form of sulfur oxides.

In current refining practice, hydrogen sulfide is generally first removed from a sour distillate by contacting the distillate with a suitable selective solvent such as monoethanol amine. Thereafter, mercaptans are removed from the distillate by reaction with an alkaline reagent thus forming water-soluble alkali metal mercaptides (i.e., spent alkaline reagent).

Any suitable alkaline reagent may be employed including particularly sodium hydroxide (caustic), potassium hydroxide, etc. The alkaline reagent generally is utilized as an aqueous solution of from about 5% to about 50% weight concentration and, when desired, solutizers, solubilizing agents, etc., are employed including, for example, alcohols and particularly methanol, ethanol, etc., phenols, cresols, butyric acid, etc., in order to increase the contact and/or reaction of the acidic components with the alkaline reagent. A number of processes are known for regenerating the alkaline reagent, basically by oxidation of the mercaptide salts to organo-disulfides. In such processes, the aqueous mercaptide-containing phase is removed from the hydrocarbon phase and is contacted with an oxygen-containing gas, ozone, etc., at ambient or slightly elevated temperature to convert the alkali metal mercaptides to organo-disulfides and regenerate alkali metal hydroxide for reuse in sweetening. Variations of the foregoing caustic regeneration process are described in U.S. Pat. Nos. 2,001,715; 2,369,771; 2,425,414; 2,516,837; 2,525,583; 2,583,136; 2,599,449; 2,651,595; 2,719,109; 2,740,748; 2,747,969; 3,757,074; 2,760,909; 2,794,767; 2,853,432; 2,882,132; 2,844,440; 3,023,084; and, 4,090,954, among others.

The American Petroleum Institutes "Manual on Disposal of Refinery Wastes/Volume on Liquid Wastes" (1969) generally discloses that air oxidation of spent alkaline solutions can be used to reduce chemical oxygen demand (COD) prior to biological treatment. However, it has been observed experimentally that an oxidation by itself does not lead to a gross reduction in COD and must be accompanied by a further treatment to render the spent alkaline solutions suitable for discharge to waste.

While FMC Corporation has described in its brochure "Hydrogen Peroxide Waste Treatment by Industry" a variety of industrial effluent treatments employing hydrogen peroxide, the publication neither discloses nor suggests the treatment of spent alkaline reagent derived from petroleum processing operations employing hydrogen peroxide.

SUMMARY OF THE INVENTION

According to the present invention, the chemical oxygen demand (COD) of a solution of spent alkaline reagent containing alkali metal mercaptides obtained from the treatment of mercaptan-containing hydrocarbon fluid, e.g., sour distillate, with an alkali metal hydroxide, e.g., sodium hydroxide (caustic) or potassium hydroxide, is substantially reduced by contacting the solution with hydrogen peroxide to convert at least a substantial amount of the alkali metal mercaptides to alkali metal sulfates and carbonates. As a result of such conversion, the COD of the spent alkaline solution is greatly reduced permitting the solution to be discharged to waste if desired. Alternatively, the treated solution can undergo further treatment to regenerate alkaline reagent. Thus, the alkali metal sulfates and carbonates can be reconverted to alkali metal hydroxide by reaction with an alkaline earth metal hydroxide, the regenerated alkali thereafter being used to treat additional quantities of sour distillate.

Very surprisingly, the aforedescribed use of hydrogen peroxide has been found to provide solutions of regenerated alkaline reagents having far lower chemical oxygen demand (COD) levels than those obtained with the use of an oxygen-containing gas such as air.

A further advantage of this process lies in the fact that unlike the regeneration procedures of the prior art which generally must be operated at the highest possible pressure to dissolve sufficient oxygen in the spent alkaline media to achieve practical levels of conversion of mercaptans to organic disulfides, e.g., 6 atm. abs. in the case of air, the regeneration process herein is entirely effective at atmospheric pressure and therefore can dispense with compressors which are relatively costly to install, operate and maintain.

DESCRIPTION OF THE PREFERRED EMBODIMENTS

As used herein, the term "spent alkaline reagent" shall be understood to refer to aqueous solutions of alkali metal mercaptides obtained from the treatment of hydrocarbon fluids and which may also contain other sulfur-containing compounds, e.g., sulfides and/or sulfonates, in the form of their alkali metal salts. The spent solutions may also contain solutilizers, i.e., water-soluble, oil-insoluble substances which promote the solubility of mercaptans in aqueous alkaline reagent. A large number of substances have been used for this purpose including lower mono and polyhydric alcohols, lower aliphatic polyamines and alkanolamines, hydroxy or amino ethers, hydrocarbon carboxylic acids such as fatty acids of 2 to 6 carbon atoms and dicarboxylic acids of 5 to 6 carbon atoms, phenols having up to 10 carbon atoms, etc. If acids have been used as solutizers, it is understood that they are contained in the spent solutions in the form of their alkali metal salts.

A spent alkaline reagent stream obtained from a distillate sweetening operation will typically contain from about 5 to 10 gm. of alkali metal mercaptides, from 15 to 20% alkali metal hydroxide and usually some minor amounts of other alkali metal salts as previously indicated.

Contact of the spent alkaline reagent with hydrogen peroxide can be effected in any suitable manner and either in batch or continuous operation.

In general, the conditions under which the spent alkaline reagent and hydrogen peroxide are contacted will be such as to provide at least a 50% decrease, and preferably at least an 80% decrease, in COD. In a continuous process, for example, an aqueous stream of spent alkaline reagent and hydrogen peroxide are continuously introduced through separate conduits into an oxidation zone. The quantity of hydrogen peroxide in this zone, and the residency time of the spent alkaline stream therein, will be arranged in such manner as to convert at least a substantial quantity of alkali metal mercaptides present in the stream to alkali metal sulfates and carbonates. Conversion levels in excess of about 50 weight percent, and preferably in excess of about 80 weight percent, of the total mercaptide originally present are suitable. Aqueous solutions of hydrogen peroxide such as those which are commercially available, e.g., ranging in concentration of hydrogen peroxide from about 3 to about 90 weight percent, and preferably, from about 27.5 to about 50 weight percent, are entirely suitable. It is generally desirable to combine the spent alkaline stream and the hydrogen peroxide reactant under fairly vigorous conditions to insure rapid and uniform distribution of oxidizer. While the oxidation reaction can be made to take place under increased pressure, no particular advantage is thought to be gained therefrom and atmospheric pressure is therefore advantageously employed in most cases. Residence time of the medium in the oxidation zone can vary from a few seconds to several hours or more, with optimum periods being determined by such factors as mercaptide level, peroxide concentration, efficiency of mixing, temperature and similar considerations. Residence times of from about 15 seconds to about 2 hours or even longer will provide acceptably high levels of conversion of mercaptide to alkali metal sulfates and carbonates in most cases. The oxidation is preferably effected at ambient temperature but can also be carried out at an elevated temperature which generally will not exceed about 200° F.

While the hydrogen peroxide-treated spent alkaline reagent solution can be directly discharged to waste without any significant additional treatment, it may be economically advantageous to regenerate at least a portion of alkaline reagent by treatment of the solution with an alkaline earth metal hydroxide, preferably calcium hydroxide due to its low cost and ready availability. The amounts of alkaline earth metal hydroxide required to effect regeneration are related to the amounts of sulfate and carbonate present and the extent to which regeneration is desired and can be readily determined for a given case employing routine experimentation. The resulting solution of regenerated alkali, preferably after removal of precipitated alkaline earth metal sulfate and carbonate, can be recycled for use in sweetening further quantities of sour distillate.

The following examples are further illustrative of the process herein for significantly reducing the chemical oxygen demand of an aqueous solution of spent alkaline reagent resulting from the treatment of mercaptan-containing hydrocarbon fluid with alkali metal hydroxide.

EXAMPLE 1

A sample of spent sodium hydroxide solution typical of that obtained from a petroleum distillate sweetening operation and containing sodium mercaptides together with lesser quantities of other sodium salts had a measured chemical oxygen demand (COD) of 41,000 mg $O_2$/liter, a highly malodorous odor and a yellow color. 250 ml. of the spent solution were contacted with about 70 ml. of a 30% by weight aqueous solution of hydrogen peroxide under ambient pressure and temperature conditions. After a period of one hour, the COD of the solution was reduced to 2,600 mg $O_2$/liter and as such, was suitable for discharge to waste without further treatment.

EXAMPLE 2

This example demonstrates the far greater oxidative effectiveness of hydrogen peroxide compared to air, other conditions being substantially the same.

A. Oxidation with Air 250 ml. of a spent sodium hydroxide solution similar to that which was treated in Example 1 had a COD of 51,000 mg $O_2$/liter. Air at a pressure of about 30 psi was blown through the solution maintained at ambient pressure and temperature for 1 hour. The COD of the air-blown solution was reduced only slightly, i.e., to 45,500 mg $O_2$/liter.

B. Oxidation with Hydrogen Peroxide

The air-blown solution of spent sodium hydroxide resulting from procedure A was contacted with 60 ml. of a 30% by weight aqueous solution of hydrogen peroxide. Following a contact period of about 1 hour, the COD of the solution was dramatically reduced to the low level of 7,700 mg $O_2$/liter.

What is claimed is:

1. A process for significantly reducing the chemical oxygen demand of an aqueous solution of spent alkaline reagent containing alkali metal mercaptide resulting from the treatment of mercaptan-containing hydrocarbon fluid with alkali metal hydroxide which consists essentially of contacting the spent alkaline reagent solution with hydrogen peroxide at ambient pressure and temperature to convert at least about 50 weight percent of the total spent alkaline reagent originally present to alkali metal sulfate and alkali metal carbonate.

2. The process of claim 1 wherein the alkali metal hydroxide is sodium hydroxide and the spent alkaline reagent contains sodium mercaptide.

3. The process of claim 1 wherein the spent alkaline reagent also contains one or more other sodium salts.

4. The process of claim 3 wherein the spent alkaline reagent contains the sodium salt of one or more solutilizers.

5. The process of claim 1 wherein the chemical oxygen demand of the spent alkaline reagent solution is reduced by at least about 50%.

6. The process of claim 1 wherein the chemical oxygen demand of the spent alkaline reagent solution is reduced by at least about 80%.

7. The process of claim 1 wherein at least about 80 weight percent of the total spent alkaline reagent originally present is converted to alkali metal sulfate and alkali metal carbonate.

8. The process of claim 1 wherein the aqueous solution of spent alkaline reagent is obtained from the sweetening of sour petroleum distillate.

9. The process of claim 1 which further comprises regenerating alkali metal hydroxide by contacting the hydrogen peroxide treated spent alkaline reagent solution with alkaline earth metal hydroxide.

10. The process of claim 9 wherein the alkaline earth metal hydroxide is calcium hydroxide.

11. The process of claim 8 wherein regenerated alkali metal hydroxide is used to treat an additional quantity of mercaptan-containing hydrocarbon fluid.

* * * * *